US005512985A

United States Patent [19]

Hogestyn

[11] Patent Number: 5,512,985

[45] Date of Patent: Apr. 30, 1996

[54] DEVELOPER AT MODIFICATION USING A VARIABLE SPEED MAGNETIC ROLLER IN AN ADMIX HOUSING

[75] Inventor: Larry G. Hogestyn, Ontario, N.Y.

[73] Assignee: Xerox Corporation, Stamford, Conn.

[21] Appl. No.: 359,257

[22] Filed: Dec. 19, 1994

[51] Int. Cl.[6] ..... G03G 21/00; G03G 15/00

[52] U.S. Cl. ..... 355/245; 355/246; 355/296; 355/298; 355/305; 118/653

[58] Field of Search ..... 355/245, 246, 355/269, 270, 296, 305, 298, 251; 118/653, 656, 657, 652; 222/DIG. 1

[56] References Cited

U.S. PATENT DOCUMENTS

| | | | |
|---|---|---|---|
| 3,947,107 | 3/1976 | Smith | 355/245 |
| 3,981,272 | 9/1976 | Smith et al. | 355/245 X |
| 4,086,650 | 4/1978 | Davis et al. | 361/229 |
| 4,110,034 | 8/1978 | Suzuki | 118/652 X |
| 4,588,667 | 5/1986 | Jones et al. | 430/73 |
| 4,639,115 | 1/1987 | Lin | 355/300 |
| 4,654,284 | 3/1987 | Yu et al. | 430/59 |
| 4,780,385 | 10/1988 | Wieloch et al. | 430/58 |
| 4,829,338 | 5/1989 | Whittaker et al. | 355/305 |
| 5,081,491 | 1/1992 | Lux et al. | 355/208 |
| 5,153,642 | 10/1992 | Folkins et al. | 355/215 |
| 5,220,392 | 6/1993 | Akiyama | 355/305 |
| 5,235,388 | 8/1993 | Rimai et al. | 355/246 |
| 5,307,124 | 4/1994 | Stelter | 355/246 |
| 5,329,340 | 7/1994 | Fukuchi et al. | 355/246 |
| 5,390,015 | 2/1995 | Nagame et al. | 355/305 |
| 5,430,530 | 7/1995 | Ott et al. | 355/246 X |

*Primary Examiner*—Matthew S. Smith

[57] ABSTRACT

Developer $A_t$ is modified using a magnetic brush structure disposed in an admix channel of a developer housing. The brush structure includes a stationary magnet arrangement, a rotating shell and a trim bar. A variable speed motor is provided for rotating the shell at different speeds for controlling developer triboelectrification performance.

2 Claims, 2 Drawing Sheets

DEVELOPER AT MODIFICATION USING A VARIABLE SPEED MAGNETIC ROLLER IN AN ADMIX HOUSING

BACKGROUND OF THE INVENTION

This invention relates generally to toner image creation and more particularly to developability control which enables a wider usable $A_t$ (i.e. a toner material's effectiveness in charging with a given carrier) range.

The invention can be utilized in the art of xerography. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

A common type of developer comprises carrier granules having toner particles adhering triboelectrically thereto. The two-component mixture is brought into contact with the photoconductive surface, where the toner particles are attracted from the carrier granules to the latent image. This forms a toner powder image on the photoconductive surface which is subsequently transferred to a copy sheet. The developed image is then fixed to the imaging surface or is transferred to a receiving substrate such as plain paper to which it is fixed by suitable fusing techniques.

In most two component development processes, the developer/toner materials are at the mercy of the development housing design: auger configuration, sump geometry, magnetic brush roll size, magnetics design, roll and auger velocity, etc. to cause tribocharging of the toner against the carrier. The auger speeds and roll velocities are usually adjusted to provide adequate flow balancing of the developer within the housing and developability that provides ample operating latitude, respectively. Once these speeds are determined, the level of tribocharging of the toner against the carrier is fixed. Hence, to modify the tribocharging, the formulation of the materials are adjusted to provide the desired tribocharging performance.

In conventional two-component xerographic development, the ability of a toner material to charge with a given carrier material is quantified as follows:

$$A_t = Tribo*(TC+C_0)$$

where Tribo is the average charge to mass ratio of toner, TC is the toner concentration in percent by weight, and $C_0$ is a constant. $A_t$ is a critical specification parameter for toner and developer; it tends to vary from batch to batch, with developer age, and with operating relative humidity. The variation with humidity is a special problem with many color toners, since this variation tends to be much larger than with comparable black toners. In general, the higher the $A_t$, the better the material charging.

Modification of the developer $A_t$ by changing the material's formulation is a long process whereby the materials must be subjected to a significant amount of both bench and lengthy and expensive full process experiments before they can be qualified for satisfactory use in a product. Also, when a product like the 4850 printer, for example, has more than one color toner, it is desirable to maintain commonality in the carrier formulation so as to minimize cost.

Following is a discussion of prior art, incorporated herein by reference, which may bear on the patentability of the present invention. In addition to possibly having some relevance to the patentability thereof, these references, together with the detailed description to follow hereinafter, may provide a better understanding and appreciation of the present invention.

In copending U.S. patent application Ser. No. 08/359,357, there is disclosed a developer control for enabling the use of developer and toner materials with widely varying $A_t$ in high quality xerographic copying and printing. Pixel count data is combined with toner test patch reflectance data during a brief toner rundown to determine the rate of change of density per unit change in toner concentration. During toner rundown, dispensing of toner is suspended for a period of time for effecting toner concentration reduction by approximately 0.25%. The change in Toner Concentration (TC) is estimated using pixel counting. Additionally, toner test patches are created and the reflectance thereof is measured for determining the change in toner density. The estimated TC change and the change in toner density are processed using linear regression to find the average change in density sensor output for the estimated change in TC which is referred to as the rundown slope.

The rundown slope is then compared to a target value. If it exceeds the target value by more than $\epsilon$ (a noise factor), the dispense setpoint is reduced by one unit. If the rundown slope is less the target value by more than $\epsilon$, the dispense point is increased by one unit. The noise factor, $\epsilon$ is attributable to errors in pixel count or reflectance sensor drift.

According to the foregoing, the nominal control line and control band in TC-Tribo space is altered to produce a much wider usable $A_t$ range.

U.S. Pat. Nos. 5,153,642 and 4,639,115 relate to devices disposed in a developer housing for removing contaminants from a developer mixture.

The '642 patent discloses an apparatus in which an electrostatic latent image recorded on a photoconductive member is developed with developer material stored in a developer housing. The developer material advances along a path of travel to a development zone closely adjacent to the latent image. A cleaner, positioned in the path of the developer material and spaced from the photoconductive member, cleans contaminants from the developer material without impeding the flow thereof. The cleaner has a multiplicity of fibers disposed in the path of travel of the developer material.

The '115 patent discloses an apparatus for purifying toner prior to its use in developing latent electrostatic images. An electrically biased roll supported in the developer housing contiguous at least one of the development rolls serves to attract paper debris from the toner contained in the toner carried by the developer roll. The roll is fabricated from a suitable insulating material and electrically biased in a manner suitable for attracting the paper debris contained in the toner. The roll is rotated and a scraper blade is provided for removing the debris therefrom. The debris so removed is allowed to fall into a toner catch tray which can be provided with an auger for moving it out of the tray to thereby increase the capacity of the system for debris removal.

While the aforementioned patents are not directed to developer $A_t$ control they deal with functions carried out in a developer housing which may be relevant to patentability of the present invention.

While increasing the $A_t$ latitude is known as disclosed in the aforementioned patent application, it will be appreciated that being able to vary the developer $A_t$ directly in order to compensate for changes in ambient conditions such as humidity is a desirable goal. Also, the capability of compensating for developer materials that do not meet an At target value is desirable.

BRIEF SUMMARY OF THE INVENTION

According to the present invention, an $A_t$ modifier device is installed within a two component developer housing, for example, in an admix auger channel where fresh toner is replenished into the developer mix.

The $A_t$ modifier comprises a magnetic roll (stationary magnets and a rotating shell) and a trim bar. The shell is able to rotate at various speeds. By varying the speed of rotation of the shell, triboelectrification of developer materials can be varied. Increasing the rotational speed of the shell increases the $A_t$ while reducing its speed effects a decrease in the developer $A_t$. The rotational speed of the shell can be varied without significantly impacting the developer flow balance in the developer housing.

DETAILED DESCRIPTION OF THE PREFERRED EMBODIMENT OF THE INVENTION

The $A_t$ modifier of the present invention can be utilized in any type of printer or copier relying on two component development, i.e. development that uses carrier beads mixed with toner particles.

Figure 3:
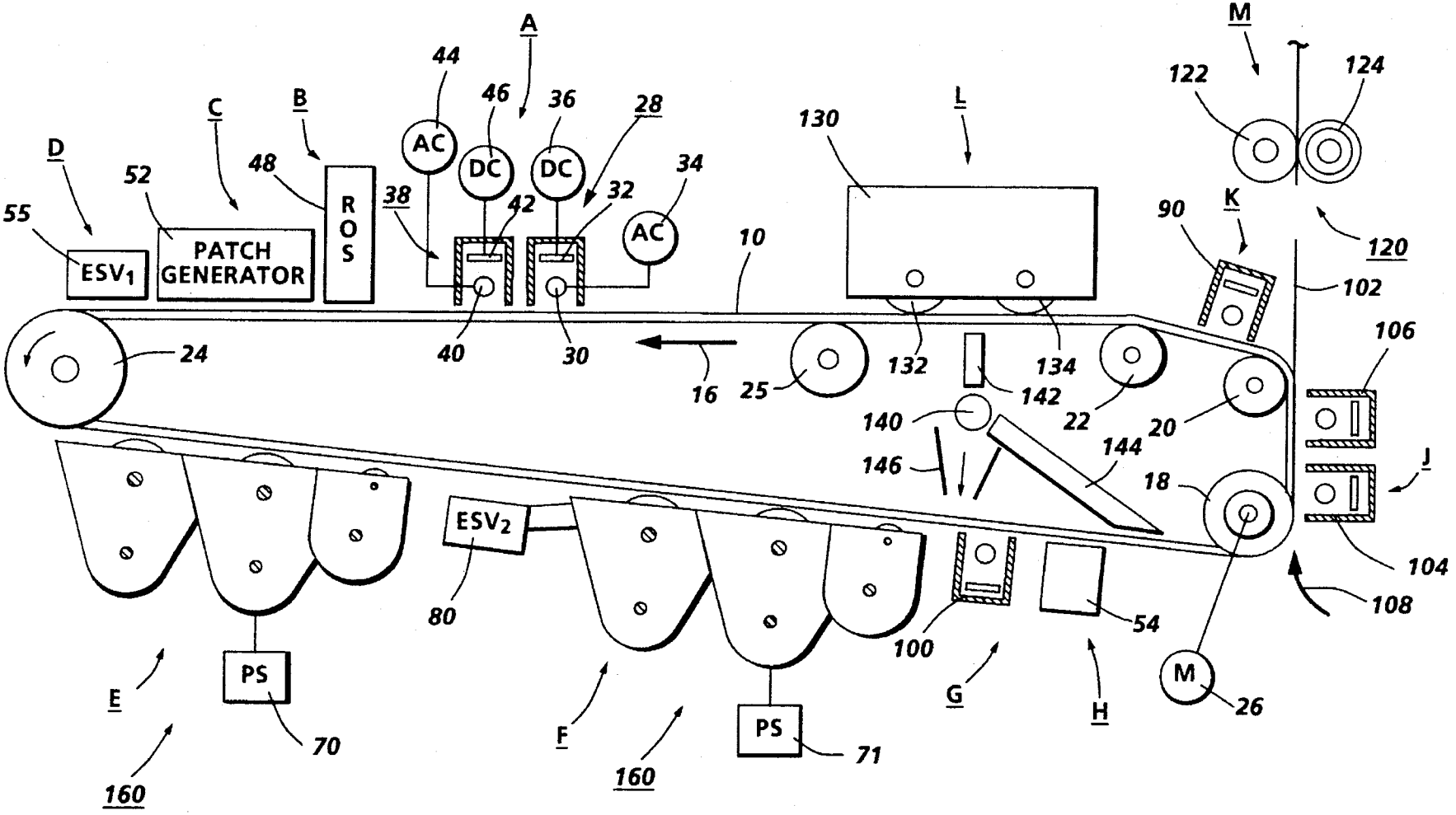
FIG. 3 is a schematic illustration of an image processor in which the developer $A_t$ modifier of the present invention may be incorporated.

As shown in FIG. 3, a highlight color printing apparatus in which the invention may be utilized comprises a xerographic processor module including a charge retentive member in the form of an Active Matrix (AMAT) photoreceptor belt 10 which is mounted for movement in an endless path past a charging station A, an exposure station B, a test patch generator station C, a first Electrostatic Voltmeter (ESV) station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 23 and 24, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor. Typical belt photoreceptors are disclosed in U.S. Pat. No. 4,588,667, U.S. Pat. No. 4,654,284 and U.S. Pat. No. 4,780,385.

As can be seen by further reference to FIG. 3, initially successive portions of belt 10 pass through charging station A. At charging station A, a primary corona discharge device in the form of dicorotron indicated generally by the reference numeral 28, charges the belt 10 to a selectively high uniform negative potential, $V_0$. The initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32. For further details of the dicorotron construction and operation, reference may be had to U.S. Pat. No. 4,086,650 granted to Davis et al on Apr. 25, 1978.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based input and/or output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD images. When exposed at the exposure station B it is discharged to $V_C$ or $V_{DAD}$ equal to about −100 volts to form a DAD image which is near zero or ground potential in the highlight color (i.e. color other than black) parts of the image. The photoreceptor is also discharged to $V_w$ or $V_{mod}$ equal to approximately minus 500 volts in the background (white) areas.

A patch generator 52 (FIG. 3) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the voltage level of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the P/R prior to movement of these areas of the P/R moving through the development station E.

Figure 1:
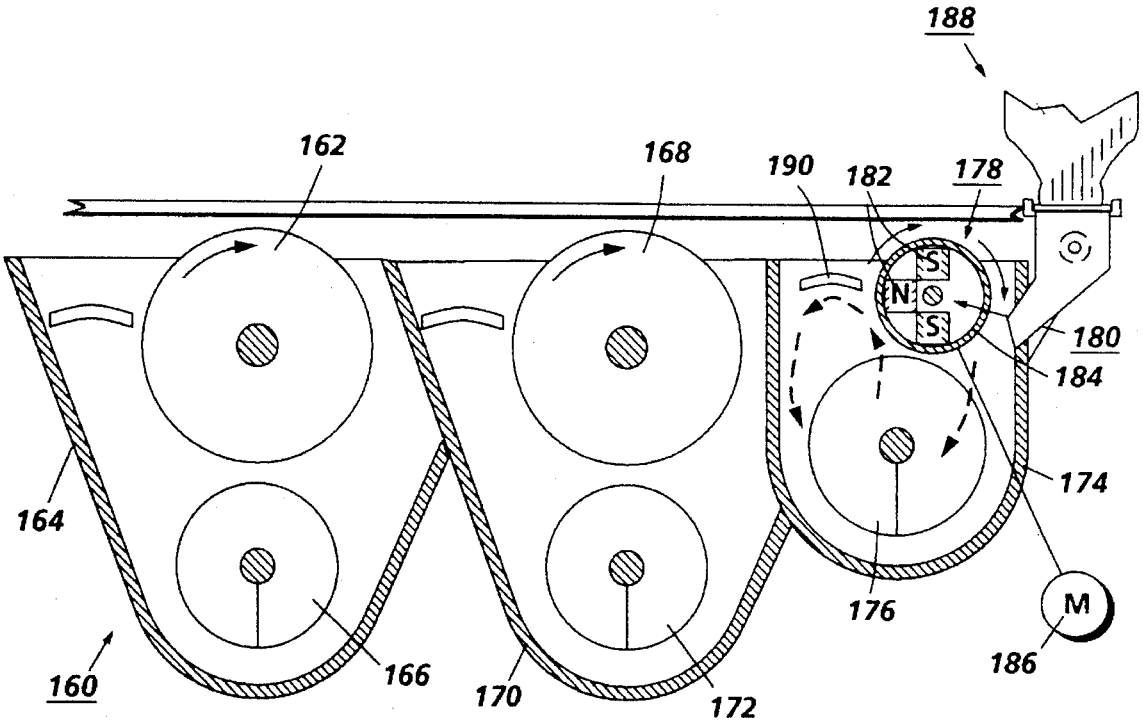
FIG. 1 is a schematic representation of a developer housing incorporating the invention.

At development Stations E and F a magnetic brush development system advances developer materials into contact with the electrostatic latent images on the P/R. The development system comprises first and second developer housing structures 160 and 160. Preferably, each magnetic brush development housing includes a pair of magnetic brush developer rollers. Thus, as depicted in FIG. 1, each housing 160 contains a pair of rollers 162 and 168. Each pair of rollers advances its respective developer material into contact with the latent image. Appropriate developer biasing is accomplished via power supplies 70 and 71 electrically connected to respective developer housings 160 and 160. A pair of toner replenishment devices 188 and 188 are provided for replacing the toner as it is depleted from the developer housing structures 160 and 160.

Color discrimination in the development of the electrostatic latent image is achieved by passing the photoreceptor past the two developer housings 160 and 160 in a single pass with the magnetic brush rolls 162, 168, 162 and 168 electrically biased to voltages which are offset from the background voltage $V_{Mod}$, the direction of offset depending on the polarity of toner in the housing. One housing e.g. 160 (for the sake of illustration, the first) contains red conductive magnetic brush (CMB) developer having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 162, 168. These rolls are biased using a chopped DC bias via power supply 70.

The triboelectric charge on conductive black magnetic brush developer in the second housing 160 is chosen so that the black toner is urged towards the parts of the latent images at the most highly charged potential $V_{CAD}$ by the electrostatic development field ($V_{CAD}-V_{black\ bias}$) existing between the photoreceptor and the development rolls 162, 168. These rolls, are also biased using a chopped DC bias via power supply 71. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the the bias on the CAD housing is at $V_{Bias\ High}$ for a duty cycle of 90–95%. Developer bias switching between $V_{Bias\ High}$ and VBias Low is effected automatically via the power supplies 70 and 71. For further details regarding CDC biasing, reference may be had to U.S. patent application Ser. No. 440,913 filed Nov. 22, 1989 in the name of Germain et al and assigned to same assignee as the instant application.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 is moved into contact with the toner image at transfer station J. The sheet of support material is advanced to transfer station J by conventional sheet feeding apparatus comprising a part of the paper handling module, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to catch trays (not shown) for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L. A cleaning housing 100 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132,134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. To this end, a light pipe 142 is provided. Another light pipe 144 serves to illuminate the backside of the P/R downstream of the pretransfer dicorotron 100. The P/R is also subjected to flood illumination from the lamp 140 via a light channel 146.

A developer housing structure 160 according to the invention, as disclosed in FIG. 1, comprises a first magnetic brush developer roller structure 162. The developer roll structure 162 is disposed in a first compartment 164 together with a first transport auger 166. A second magnetic brush roller structure 168 is disposed in a second compartment 170 along with a second transport auger 172. In a third compartment or admix auger channel 174, there is provided an admix auger 176 for mixing newly added toner with the a developer mixture present in the channel 174.

The channel 174 also contains an At modifier structure 178 according to the invention. The structure 178 comprises a magnetic brush 180 consisting of stationary magnets 182 and a shell 184, the latter of which is supported for rotation by a variable speed motor 186. The speed of the motor 186 can be automatically varied in response to sensed changes in humidity conditions. Alternatively, the speed of the motor can be manually controlled by a user via a User Interface (UI), also not shown. Process control algorithms and sensing devices for automatically controlling the speed of the motor do not form a part of this invention. However, it is noted that such items are well within the capabilities of present microprocessor based machine controllers.

The $A_t$ modifier structure 178 is used to increase or decrease the developer $A_t$ by increasing or decreasing the rotational speed of the shell 184 without significantly impacting the developer balance in a developer channel 174.

In operation, the shell 184 which has a high friction surface picks up developer out of the auger channel and transports it past a trim bar 190 for trimming excess developer material. The developer is then dumped back into the auger channel 174. If on the other hand the rotational speed of the augers 166 or 172 is varied to modify mixing performance, the flow rate of the developer within the associated housing would be affected and could cause difficulty with developer pickup and trim. Fresh toner is dispensed into the auger channel from a toner dispenser 188.

The auger 176 rotatably supported in the auger channel 174 serves to mix and transport developer material to the developer channel 174. The blades of the auger, in typical fashion, are designed to advance the developer material in the axial direction substantially parallel to the longitudinal axis of the auger shaft. As successive electrostatic latent images are developed, the toner particles within the developer material are depleted. The toner dispenser 188 stores a supply of toner particles and is in flow communication with the channel 174. As the concentration of toner particles in the developer material is decreased, fresh toner particles are furnished to the developer material in the channel from the toner dispenser. The auger structure in the chamber of the housing mixes the fresh toner particles with the remaining developer material so that the resultant developer material therein is substantially uniform with the concentration of toner particles being optimized. In this way, a substantially constant amount of toner particles are provided to the channel 174.

It may now be appreciated that there has been disclosed a developer $A_t$ modifier which could be used to compensate for developer materials that do not meet an At target value. For example, for a developer having an $A_t$ of 50 with a target value of 65, the rpm of the shell could be increased thereby effecting an increase in triboelectrification and increased $A_t$. On the other hand if the developer material had an $A_t$ of 80 with the same target value, the rpm of the shell could reduced, assuming that the shell runs constantly.

In the situation where developer $A_t$ changes with changes in relative humidity, when the relative humidity is low the shell speed is reduced and when the relative humidity is high the speed is increased. This would enable a more constant $A_t$ performance throughout the environmental zones thereby enabling increased operating latitude and a reduced number of service calls due to poor print quality induced by large $A_t$ swings.

Figure 2:
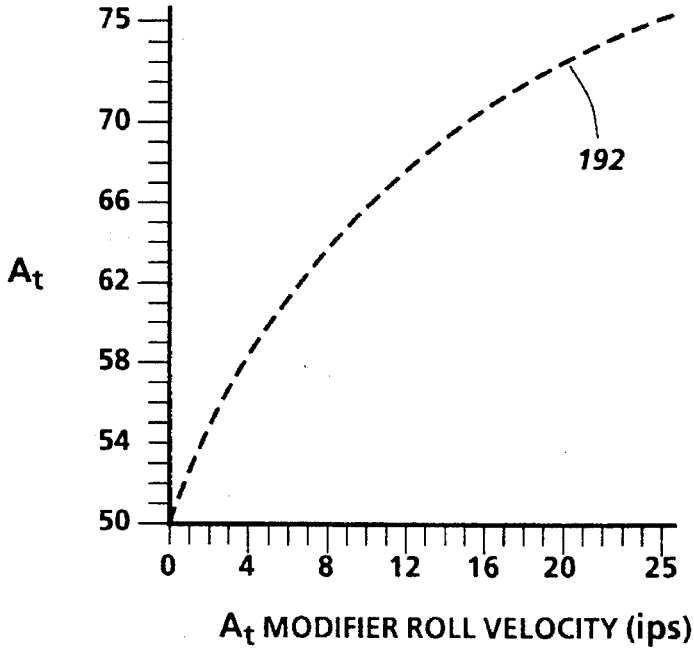
FIG. 2 is a plot of the rotational speed of an $A_t$ modifier member versus $A_t$ values at respective speeds.

FIG. 2 is a plot of At vs shell velocity depicted by curve 192 illustrating the effect on $A_t$ for various velocities of the shell 184. As shown therein, as the shell roll velocity increases the $A_t$ also increases.

What is claimed is:

1. Developer $A_t$ modification apparatus comprising:

an admix channel;

an admix auger in said channel;

developer material comprising carrier beads and toner;

means for adding fresh toner to said channel;

means including a stationary magnet arrangement, a rotatable shell encircling said arrangement and a trim bar adjacent said admix auger for varying the $A_t$ of said developer, At being proportional to:

$$Tribo*(TC+C_o)$$

where Tribo is the average charge to mass ratio of toner, TC is the toner concentration in percent by weight, and $C_0$ is a constant; and a variable speed motor operatively coupled to said shell for effecting rotation thereof at different speeds whereby a more constant $A_t$ is provided throughout various environmental zones.

2. An electrophotographic printing machine of the type in which an electrostatic latent image recorded on a photoconductive member is developed to form a visible image thereof, machine comprising:

a housing defining a channel storing a supply of developer material;

means for advancing the developer material along a path of travel to a developer channel;

means for adding fresh toner to said channel;

means including a stationary magnet arrangement, a rotatable shell encircling said arrangement and a trim bar adjacent said admix auger for varying the $A_t$ of said developer, At being proportional to:

$$Tribo*(TC+C_o)$$

where Tribo is the average charge to mass ratio of toner, TC is the toner concentration in percent by weight, and $C_0$ is a constant; and a variable speed motor operatively coupled to said shell for effecting rotation thereof at different speeds whereby a more constant $A_t$ is provided throughout various environmental zones.

* * * * *